United States Patent [19]

Fields

[11] Patent Number: 4,529,227

[45] Date of Patent: Jul. 16, 1985

[54] DEVICE FOR INTRODUCING FORMS INTO A COMPUTER PRINTER

[76] Inventor: Robert J. Fields, 2811 Adeline Dr., Burlingame, Calif. 94010

[21] Appl. No.: 501,647

[22] Filed: Jun. 6, 1983

[51] Int. Cl.[3] ..... B41L 1/00; B41L 1/36; B42D 15/00

[52] U.S. Cl. ..... 282/5; 281/2; 282/DIG. 2; 283/66 R

[58] Field of Search ..... 281/2, 5; 282/1 R, 2, 282/3 R, 5, 15 B, DIG. 2; 283/1 R, 61, 62, 66 R

[56] References Cited

U.S. PATENT DOCUMENTS

| | | | |
|---|---|---|---|
| 1,587,133 | 6/1926 | Anhof | 283/1 R X |
| 2,220,499 | 11/1940 | Thomas | 281/2 |
| 2,747,894 | 5/1956 | Porter | 282/DIG. 2 |
| 4,070,223 | 1/1978 | Stalzer | 282/DIG. 2 |
| 4,300,790 | 11/1981 | Griffin | 283/66 R X |
| 4,394,038 | 7/1983 | Klein | 282/DIG. 2 |
| 4,448,558 | 5/1984 | Weingarten | 282/DIG. 2 |

FOREIGN PATENT DOCUMENTS

| | | | |
|---|---|---|---|
| 3204964 | 8/1983 | Fed. Rep. of Germany | 281/2 |

*Primary Examiner*—Paul A. Bell
*Attorney, Agent, or Firm*—Henderson & Sturm

[57] ABSTRACT

A device for introducing forms into a printer of a computer to facilitate alignment of the forms with respect to the printer and to obviate wasted forms. Said device comprises a flexible sheet having a row of holes disposed along at least one edge of the sheet, means for removably attaching the forms to the flexible sheet and at least one reference line printed on the surface of the sheet for aligning the forms with respect to the printer. Said means can additionally comprise at least one self-adhesive area disposed on the surface of the flexible sheet for removably attaching the pre-printed form thereto.

1 Claim, 2 Drawing Figures

DEVICE FOR INTRODUCING FORMS INTO A COMPUTER PRINTER

BACKGROUND OF THE INVENTION

1. Field of Invention

This invention relates generally to a device for introducing pin-feed, connected forms into a computer printer and, more particularly, pertains to a device that permits said forms to be cooperatively engaged with the tractors of said printer without unnecessary waste of the forms. Alternatively, the device can be utilized to print individual forms.

The term "forms" as used herein shall include individual sheets of paper of all sizes, whether blank or pre-printed, with or without pin-feed holes, and shall also include connected sheets of paper, whether printed or blank, with or without pin-feed holes aligned along opposite edges of the forms.

2. Description of the Prior Art

Current practice among businesses utilizing computers and their associated printers is to make use of preprinted forms for payroll checks, vouchers, purchase orders, invoices, statements, financial records, income tax forms, etc. These forms are often multipart meaning that the printer prints more than one copy simultaneously by use of carbon paper or chemical means interposed between copies of the desired form. Consequently, it is desirable to reduce the number of wasted forms in order to control the costs of utilizing said preprinted forms.

Because computer printers are adapted to utilize a multiplicity of different styles and sizes of preprinted forms, it is desirable to provide a means to obviate the necessity for those forms which are utilized strictly for introduction into the printer, and are not actually otherwise utilized in the printing process. Moreover, it is desirable to provide a means for insuring correct alignment of the forms to minimize waste when aligning the forms with respect to the printhead when the forms are first loaded into the printer.

The problem of waste is exacerbated by the fact the preprinted forms are often sequentially numbered resulting in additional bookkeeping to account for those forms wasted in the loading and alignment process.

Consequently, unnecessary costs are incurred each time the type of form utilized in a particular computer printer is changed utilizing prior art methods. More particularly, not only is there a waste of materials as a result of the voided forms, but the labor involved in keeping records of the number of voided forms is also considerable.

U.S. Pat. No. 4,070,223 issued to Stalzer discloses an apparatus and method for introducing connected forms into an associated device. This reference discloses a strip having a single row of indexing holes therein and connecting means on said strip for connecting the strip to the pre-printed forms. The method utilizing the apparatus disclosed therein has several disadvantages in that the strip so utilized must be manually affixed and detached from the pre-printed forms. Moreover, the strips add to the costs of changing the pre-printed forms because new strips must be utilized each time new forms are introduced into the printer.

An additional problem exists where individual forms are desired to be printed. Often individual forms, especially bank checks, memo forms, etc., do not have sufficient width or height to cooperatively engage the tractors of a printer and simultaneously be printed. Additionally, certain forms are not printed on pin-feed stock, and thus are not designed to be utilized in printers having tractors.

Therefore, it is desirable to provide a device which permits easy and reproducable alignment of the desired pre-printed forms with respect to the printer and obviates waste of the forms.

Additionally, it is desirable to provide means for printing individual forms as well as those forms not having pin-feed holes. Where individual forms do not provide means for pin-feed engagement, a device is provided which has the individual forms affixed thereto and the means for engaging the device with the printer.

SUMMARY OF THE INVENTION

Therefore, it is provided in the practice of this invention according to a presently preferred embodiment, a device for introducing forms into a printer of a computer to facilitate alignment of the forms with respect to the printer and to obviate wasted forms. Said device comprises a flexible sheet having a row of holes disposed along at least one edge of the sheet, means for removably attaching the forms to the flexible sheet, and at least one reference line printed on the surface of the sheet for aligning the forms with respect of the printer. The means for removably attaching at least one of the forms to the flexible sheet can comprise at least one pair of slots formed within the flexible sheet and diagonally disposed with respect to the edges of the sheet for attaching the corners of the pre-printed form. Said means can additionally comprise at least one self-adhesive area disposed on the surface of the flexible sheet for removably attaching the pre-printed form thereto.

BRIEF DESCRIPTION OF THE DRAWINGS

These and other features and advantages of the present invention will be better understood by reference of the following detailed description when considered in connection with the accompanying drawings wherein.

DESCRIPTION OF THE PREFERRED EMBODIMENTS

Figure 1:
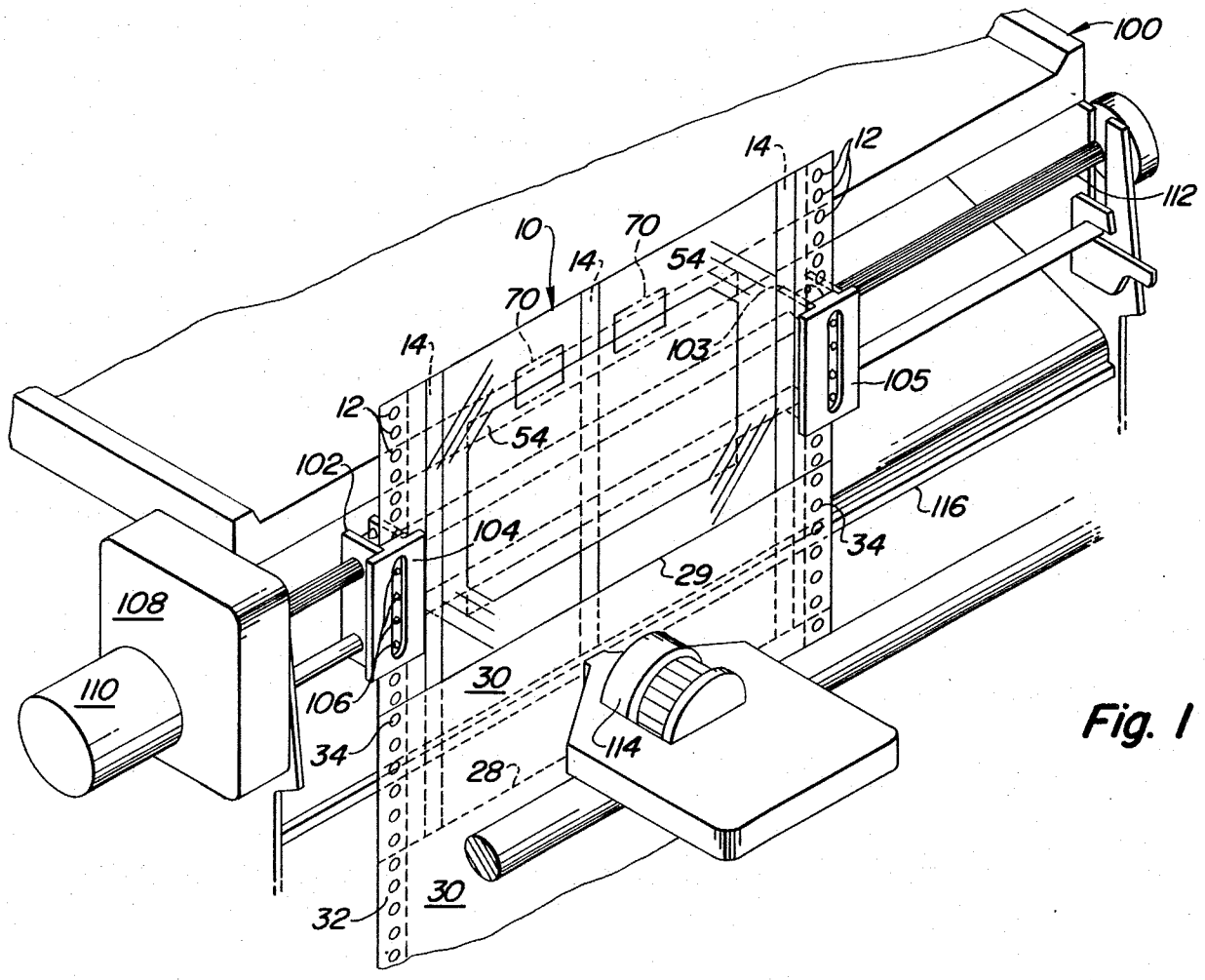
FIG. 1 is a perspective view illustrating the use of the device in conjunction with a typical computer printer constructed according the principles of this invention.
Figure 2:
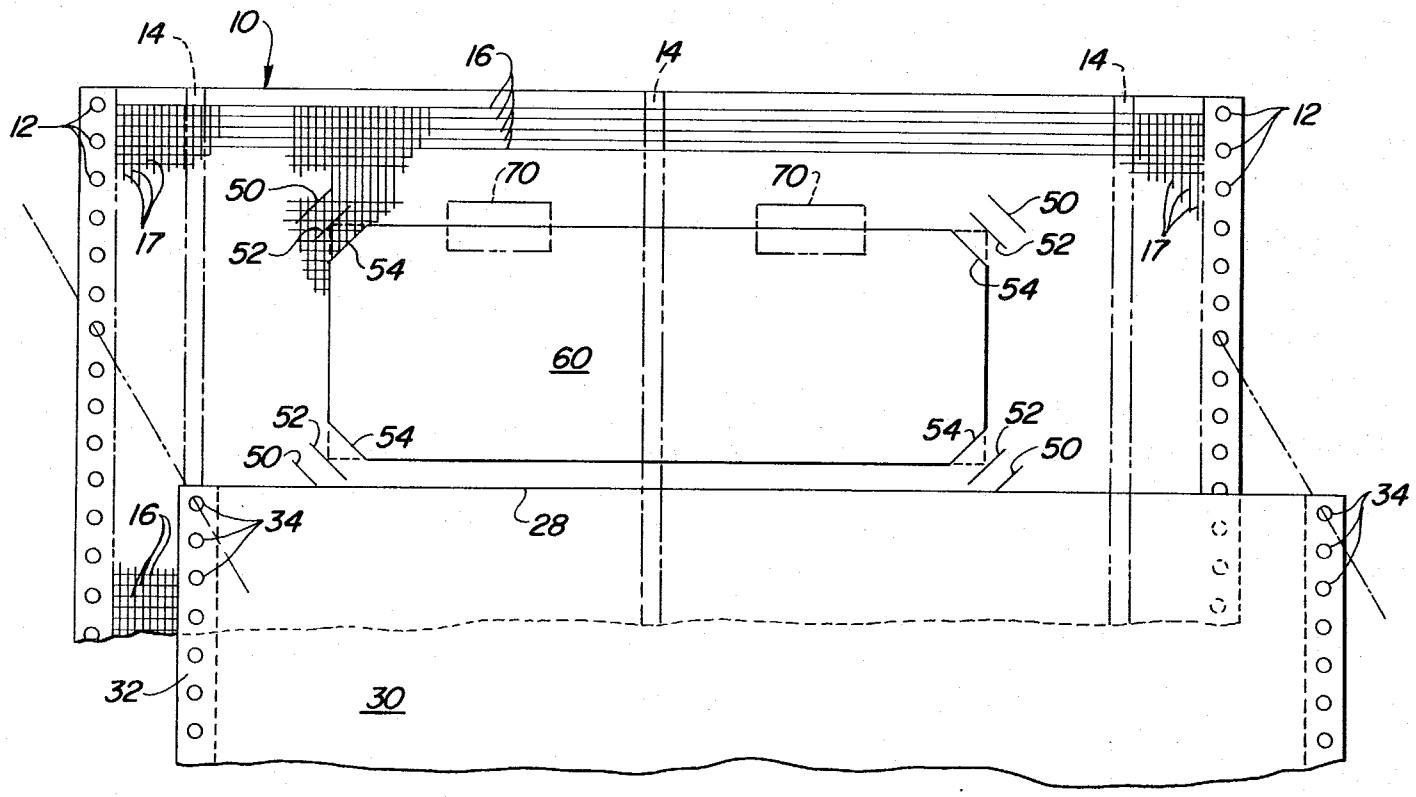
FIG. 2 is a plan view of the device.

FIGS. 1 and 2 show a preferred embodiment of the device 10 constructed according to the principles of the invention. A form 30 is shown being introduced into a typical printer 100 of a computer (not shown). The form 30 is part of a package (not shown) of continuous forms where each form 30 can be selectively separated along perforations 28 projecting perpendicularly and transversly with respect to the longitudinal axis of the continuous form. Each form 30 additionally comprises two rows of circular sprocket holes 34. Said rows of holes 34 are disposed in close proximity to each of the edges of the form which are parallel to the longitudinal axis of the continuous form.

Said holes 34 are on centers selected to coincide with the industry standard distance between the pins 106 of the tractors 102 and 103 of the typical computer printer 100. Said tractors 102 and 103 are coupled to a motor 110 through a drive mechanism 108 and drive shaft 112. The computer or the printer 100 itself directs commands to the motor to advance the forms with respect to the printhead 114 such that individual lines of print can be generated on the desired line of the form 30.

Because the tractors 102 and 103 are responsible for advancing the form 30 with respect to the printhead 114 and the print anvil 116, and because said tractors are positioned above said printhead 114, it is common practice to waste at least one form 30 in order that the package of the connected forms may be introduced to the printer 100 by cooperatively engaging the pins 106 with the holes 34 of the form 30. Moreover, second and subsequent forms may also be wasted to obtain the proper vertical and horizontal alignment of the form 30 with respect to the printhead 114 itself.

The device 10 is constructed from a flexible sheet of plastic preferably clear mylar and is rectangular or square in shape. The width of the device 10 is selected to be equal to the width of the desired pre-printed form 30 where the form also defines sprocket holes 34 for engaging the tractors 102 and 103 of the printer.

Disposed in close proximity to opposite edges of the form 30 are two rows of circular sprocket holes 12. Said holes 12 are on centers selected to coincide with the industry standard distance between the pins 106 of the tractors 102 and 103 of the printer 100.

Disposed on one side of the device 10 are areas of self-adhesive material 14. Said areas comprise strips of approximately one-half inch to one inch in width running from the top to the bottom of the device 10. Said adhesive is selected from those types of adhesives that permit repeated attachment and removal of the form 30 to and from the device 10. In the preferred embodiment, a pressure sensitive adhesive such as that used by 3M for its "Post-It" brand notepads is utilized. However, other adhesives such as those used in double-stick tape may also be employed. Alternatively, short strips of removably self-adhesive tape 70 can be utilized for removably attaching the form 30 from the device 10.

A plurality of parallel "vertical" lines 17 are inscribed or printed on one surface of the device 10 parallel to the edges of the form having the sprocket holes 12 disposed in close proximity thereto. Said vertical lines 17 are preferably spaced 1/10 of an inch apart to comport the with the industry standard print density of 10 characters per inch. Alternatively, said lines 17 can be disposed at intervals of $\frac{1}{8}$" or 1/12" when expanded or compressed printing respectively is intended to be utilized.

A plurality of parallel "horizontal" lines 16 are printed or inscribed on one surface of the device 10 and are oriented perpendicularly to the vertical lines 17 already described. Spacing between said horizontal lines 16 is preferred to be 1/6" to conform with industry standard horizontal spacing for printers. However, spacing may be selected to be $\frac{1}{8}$" when compressed printing is desired.

Because of the device 10 can be manufactured having a multiplicity of combinations of lengths and widths, it is necessary for the user to select a width of the device 10 which is equal to the width of the desired pre-printed form 30. It is also necessary to select a length sufficient to cooperatively engage the pins of the printer tractors while permiting the desired form to be positioned under the printhead.

The device 10 is utilized by aligning the holes 34 of the form 30 with the holes 12 of the device. Typically the leading edge 28 of a first form 30 of a packet of connected forms is aligned with a pre-selected horizontal line 16. Such alignment is selected to permit adequate overlap of the device 10 to act as a "leader" for cooperatively engaging the pins 106 of the tractors 102 and 103 such that the printhead 114 may print the desired line on the form 30.

The self-adhesive areas 14 provide the means for removeably attaching the form 30 to the device 10 to maintain the proper alignment therebetween until the combined form 30 and device 10 is engaged with the printer 100. Additionally, said self-adhesive areas assist in guiding the leading edge 28 of the form 30 through the print mechanism because it prevents separation of the form from the device and consequent jamming that may result from said separation.

In an alternative embodiment also shown in FIGS. 1 and 2, the device 10 defines slots which are grouped in sets 50, 52, and 54 of four and shown in a typical arrangement. This embodiment permits the user to selectively print an individual form 60 which has a width which is less than that of the device 10. Each slot of the sets of slots 50, 52, and 54 are disposed diagonally with respect to the vertical lines 17 to accomodate each of the four corners of the desired pre-printed forms 60. As shown, the largest form would be accomodated by slots 50 and the smallest would be accomodated by slots 54. The slots have adequate length to provide the user means to adjust the vertical and horizontal alignment of the form 60 with respect to the printhead 114. The vertical lines 17 and horizontal lines 16 provide means for accurately reproducing the alignment of particular individual forms. Additionally, the self-adhesive areas 14 provide means for removably attaching the individual form 60 from the device 10.

The described embodiments of the invention are only considered to be preferred and illustrative of the inventive concept. The scope of the invention is not restricted to such embodiments. Various and numerous other arrangements may be devised by one skilled in the art without departing from the spirit or the scope of this invention. For example, alphanumeric characters can be utilized for identifying the various horizontal 16 and vertical lines 17 to assist in accurately reproducing the alignment of the forms. Additionally, the device can be manufactured from materials other than clear mylar such as colored transparent or opaque plastics and papers.

I claim:

1. A device for introducing connected forms of a printer of a computer by cooperatively engaging the pins of a tractor of the printer in order to facilitate alignment of the forms with respect to the printer and to obviate wasted forms comprising:

a flexible rectangular sheet of a clear plastic having a row of circular holes aligned along each of two opposite edges of the sheet and having spacing between said holes selected to coordinate with the pins of the tractor of the printer;

a plurality of self-adhesive areas disposed on the surface of the plastic sheet;

a plurality of pairs of slits formed within the plastic sheet and diagonally disposed with respect to the edges of the sheet; and a grid printed on the surface of the sheet for aligning the forms with respect to the printer.

* * * * *